US007976290B2

(12) United States Patent
Wang

(10) Patent No.: US 7,976,290 B2
(45) Date of Patent: Jul. 12, 2011

(54) AIR PUMP WITH SHEET METAL BRACKET

(76) Inventor: Wei-Chi Wang, Tainan (TW)

( * ) Notice: Subject to any disclaimer, the term of this patent is extended or adjusted under 35 U.S.C. 154(b) by 491 days.

(21) Appl. No.: 11/692,502

(22) Filed: Mar. 28, 2007

(65) Prior Publication Data

US 2008/0240943 A1 Oct. 2, 2008

(51) Int. Cl.
*F04B 17/00* (2006.01)
*F04B 35/00* (2006.01)
*F16M 1/08* (2006.01)

(52) U.S. Cl. ..... 417/360; 417/415; 248/300; 248/674

(58) Field of Classification Search ..... 417/415, 417/545, 360, 423.15; 254/8 B, 93 H; 248/300, 248/314, 316.1, 200, 205.1, 309.1, 645, 646, 248/672, 673
See application file for complete search history.

(56) References Cited

U.S. PATENT DOCUMENTS

| | | | | | |
|---|---|---|---|---|---|
| 625,427 | A * | 5/1899 | Stewart | 403/190 |
| 2,745,169 | A * | 5/1956 | Scheldorf | 29/897 |
| 3,545,897 | A * | 12/1970 | Russell | 417/542 |
| 3,606,597 | A * | 9/1971 | Russell | 417/542 |
| 4,601,378 | A * | 7/1986 | Pierce et al. | 192/115 |
| 4,925,158 | A * | 5/1990 | Yang | 254/8 B |
| 5,215,447 | A * | 6/1993 | Wen | 417/415 |
| 5,244,363 | A * | 9/1993 | Olson | 417/490 |
| 5,295,653 | A * | 3/1994 | Miyazaki et al. | 248/675 |
| 5,356,105 | A * | 10/1994 | Andrews | 248/221.11 |
| 6,135,725 | A * | 10/2000 | Chou | 417/360 |
| 6,193,475 | B1 * | 2/2001 | Rozek | 417/360 |
| 6,218,752 | B1 * | 4/2001 | Chang et al. | 310/91 |
| 6,280,163 | B1 * | 8/2001 | Chou | 417/550 |
| 6,716,003 | B2 * | 4/2004 | Chen | 417/415 |
| 6,783,333 | B2 * | 8/2004 | Wang | 417/307 |
| 7,240,642 | B2 * | 7/2007 | Chou | 123/41.35 |
| 7,273,358 | B2 * | 9/2007 | Wang | 417/415 |
| 7,462,018 | B2 * | 12/2008 | Chou | 417/415 |
| 2006/0216168 | A1 * | 9/2006 | Wang | 417/415 |
| 2006/0228233 | A1 * | 10/2006 | Cook | 417/360 |

* cited by examiner

*Primary Examiner* — Devon C Kramer
*Assistant Examiner* — Nathan Zollinger
(74) *Attorney, Agent, or Firm* — Rabin & Berdo, P.C.

(57) ABSTRACT

An air pump has a bracket, a motor, a transmission device and pneumatic cylinder assembly. The bracket is formed from sheet metal and has a backplate, two side plates formed on the backplate and two top plates formed respectively on the side plates. The motor is mounted on the transmission device. The transmission device is mounted on the bracket and is connected to the motor. The pneumatic cylinder assembly is mounted on the bracket and is connected to the transmission device. The bracket formed from sheet metal is light and has a low cost.

5 Claims, 6 Drawing Sheets

AIR PUMP WITH SHEET METAL BRACKET

BACKGROUND OF THE INVENTION

1. Field of the Invention

The present invention relates to a pump, and more particularly to an air pump that is light and has a low cost.

2. Description of Related Art

Air pumps are generally used to pump air into inflatable articles such as tires.

A conventional air pump has a bracket, a motor, a transmission assembly and a pneumatic cylinder. The bracket is manufactured by casting. The motor is mounted on the bracket and has a shaft capable of rotating. The transmission assembly is mounted on the bracket and is connected to the shaft of the motor. The pneumatic cylinder is mounted on the bracket and is connected to the transmission assembly so that the motor drives the pneumatic cylinder through the transmission assembly to pump air to an inflatable article such as a tire or an inflatable mattress.

However, the process for casting the bracket is complicated, expensive and has a low production rate so that the bracket has a high cost. Furthermore, the cast bracket is heavy so that carrying the air pump is inconvenient.

To overcome the shortcomings, the present invention provides an air pump to mitigate or obviate the aforementioned problems.

SUMMARY OF THE INVENTION

The main objective of the invention is to provide an air pump that is light and has a low cost.

An air pump in accordance with the present invention comprises a bracket, a motor, a transmission device and pneumatic cylinder assembly. The bracket is formed from sheet metal and has a backplate, two side plates formed on the backplate and two top plates formed respectively on the side plates. The motor is mounted on the transmission device. The transmission device is mounted on the bracket and is connected to the motor.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
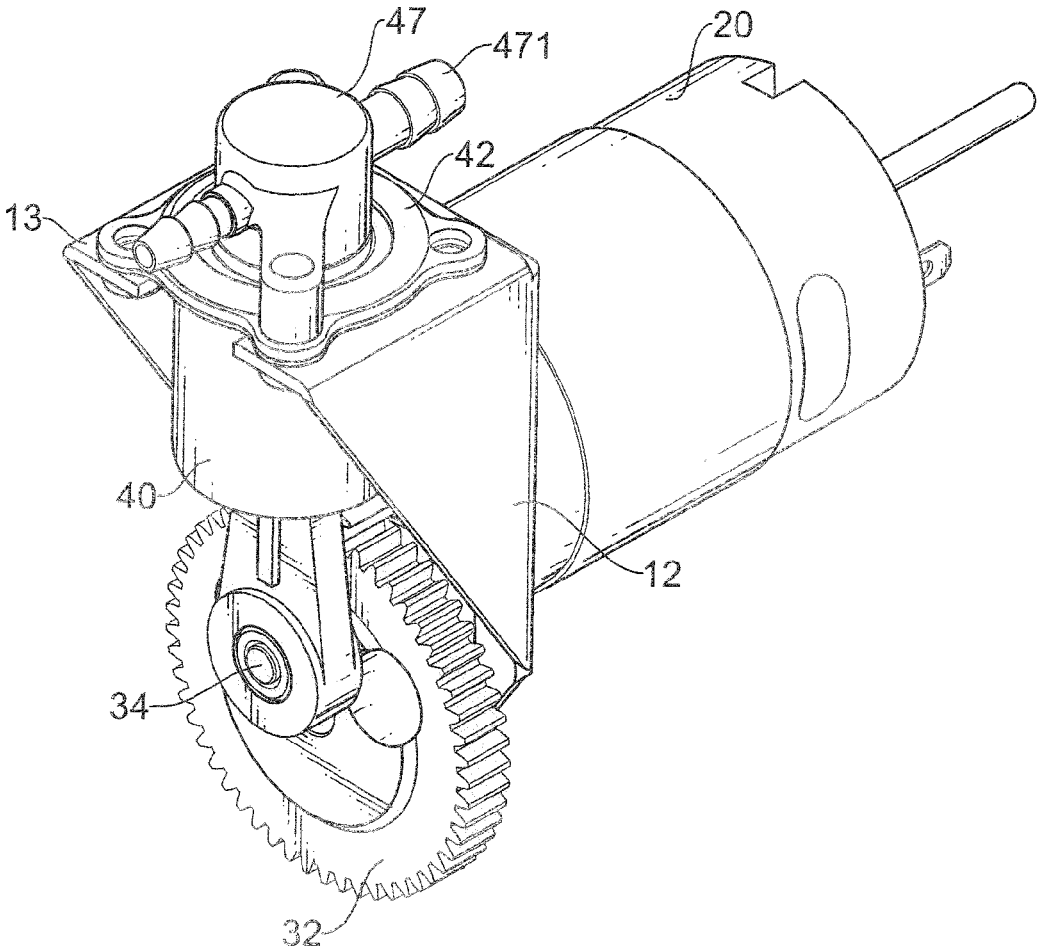
FIG. 1 is a perspective view of an air pump in accordance with the present invention.
Figure 2:
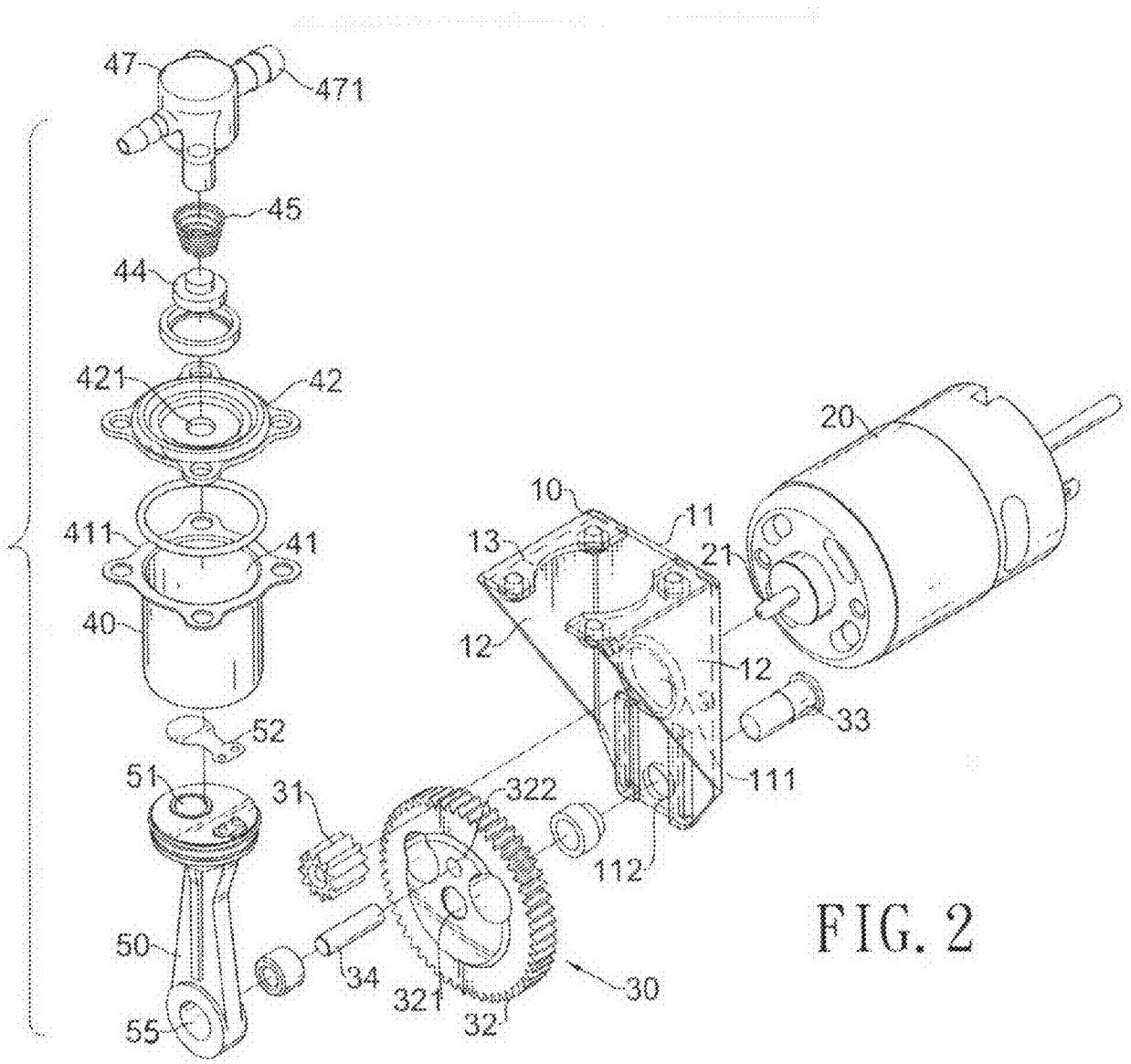
FIG. 2 is an exploded perspective view of the air pump in FIG. 1.

With reference to FIGS. 1 and 2, an air pump in accordance with the present invention comprises a bracket (10), a motor (20), a transmission device (30) and a pneumatic cylinder assembly.

Figure 3:
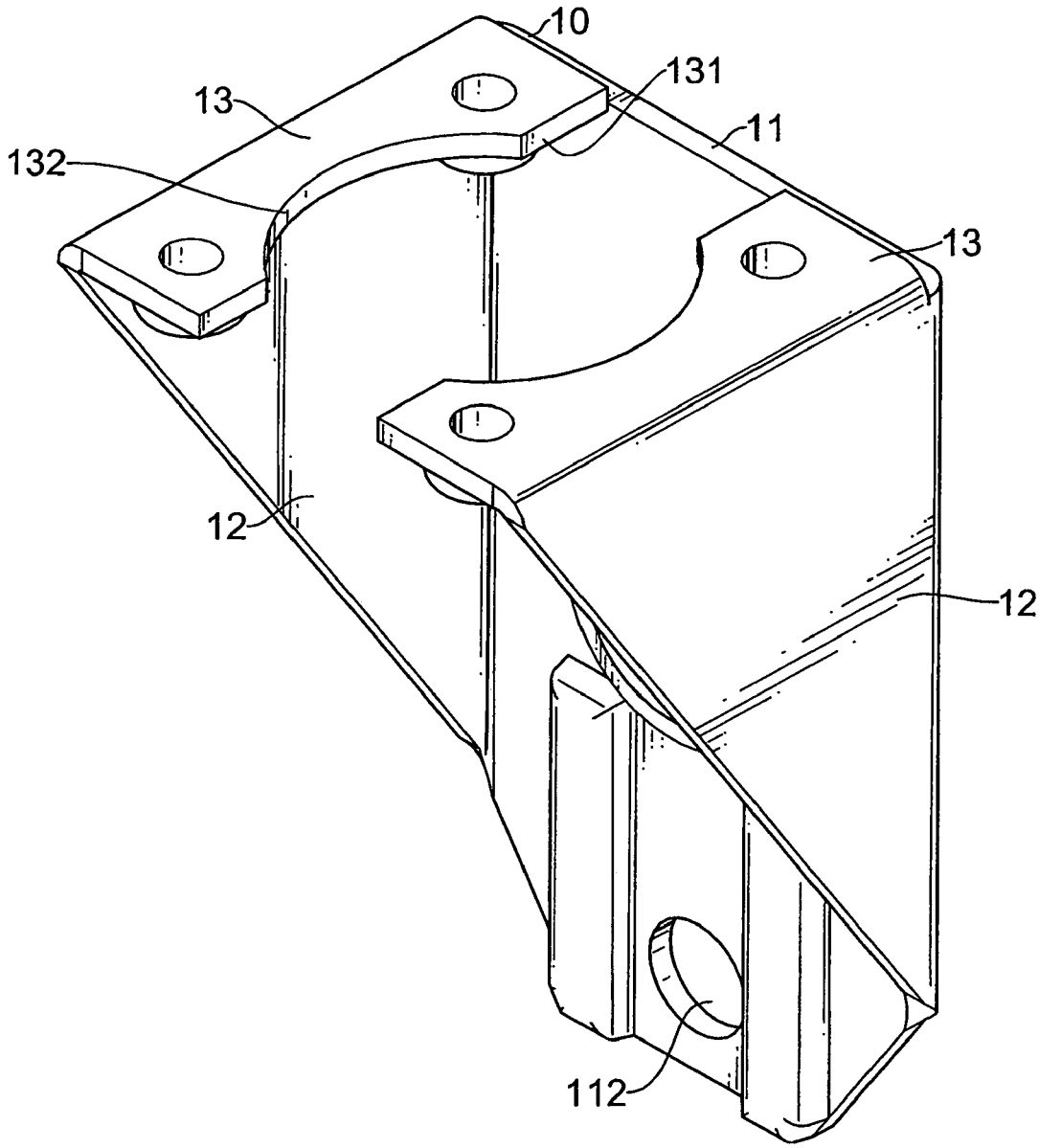
FIG. 3 is an enlarged perspective view of the bracket of the air pump in FIG. 2.

With further reference to FIG. 3, the bracket (10) is hollow, is formed integrally from a single sheet metal having a conventional uniform and even thickness, and has a backplate (11), two side plates (12) and two top plates (13).

The backplate (11) has two opposite sides, a mounting hole (111) and a pivot hole (112).

The mounting hole (111) and the pivot hole (112) are defined through the backplate (11).

The side plates (12) may be triangular and are formed respectively on and protrude respectively forward from the sides of the backplate (11) and each side plate (12) has a top edge.

The top plates (13) are formed respectively on and protrude respectively inward from the top edges of the side plates (12) and face other at an interval. Each top plate (13) has an inside edge (131) and a curved positioning recess (132) defined in the inside edge (131). The curved positioning recesses (132) of the top plates (13) are located opposite to each other.

The motor (20) is mounted on the bracket (11) and has a front end and a shaft (21).

The front end (2) of the motor (20) is mounted through the mounting hole (111) in the bracket (10).

The shaft (21) is mounted rotatably mounted on the front end.

Figure 4:
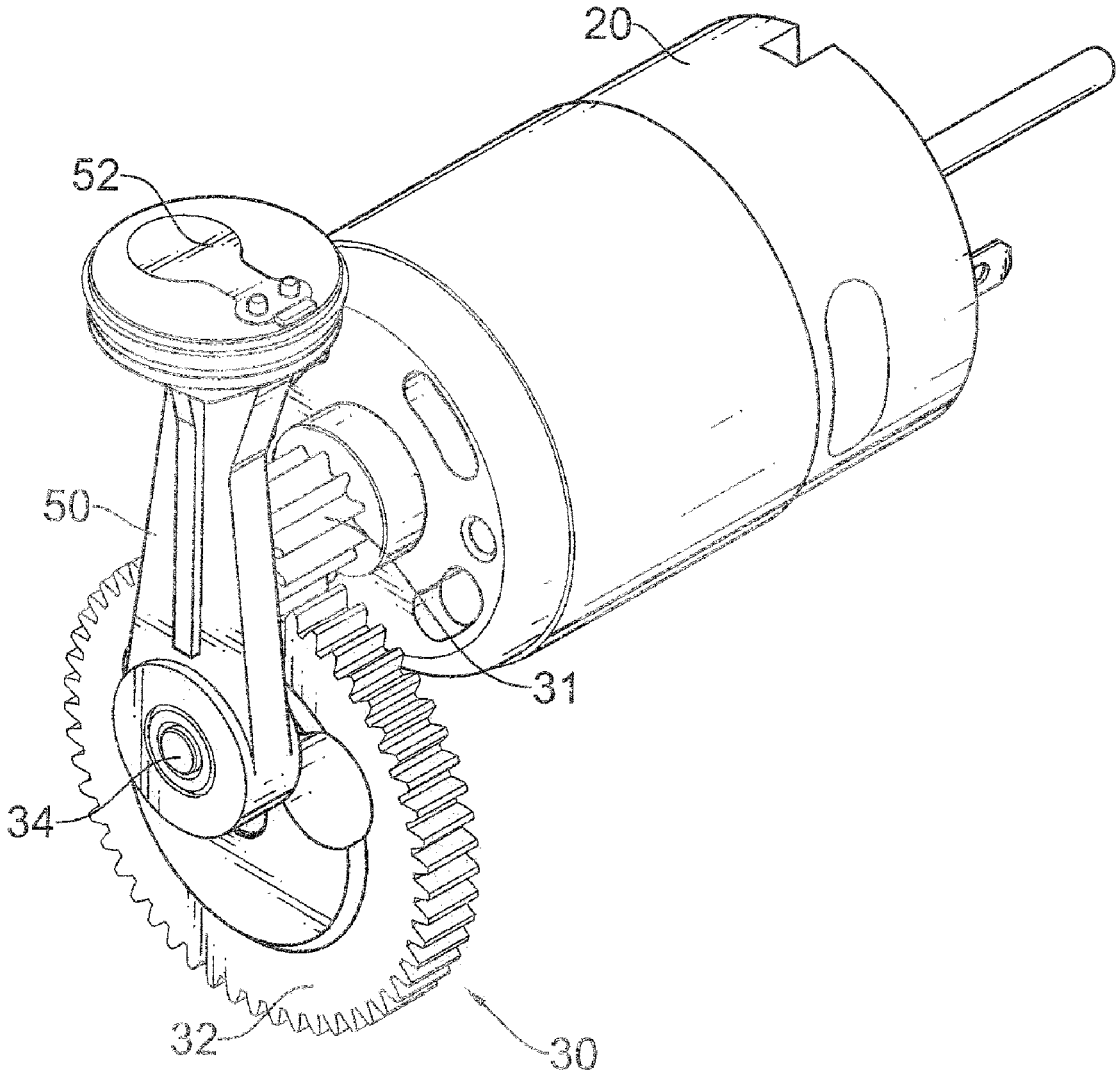
FIG. 4 is an enlarged perspective view of the motor, the transmission device and the piston of the air pump in FIG. 1.

With further reference to FIG. 4, the transmission device (30) is mounted on the bracket (10), is connected to the shaft (21) on the motor (20) and has a driving gear (31), a pivot pin (33), a driven gear (32) and an eccentric pin (34).

The driving gear (31) is mounted around the shaft (21). The pivot pin (33) is mounted in the pivot hole (112) in the bracket (10).

The driven gear (32) is mounted rotatably around the pivot pin (33), engages with the driving gear (31) and has a pivot hole (321) and an eccentric hole (322). The pivot hole (321) is defined centrally through the driven gear (32) and is mounted rotatably around the pivot pin (33). The eccentric hole (322) is defined eccentrically through the driven gear (32).

The eccentric pin (34) is mounted in the eccentric hole (322) in the driven gear (32).

Figure 5:
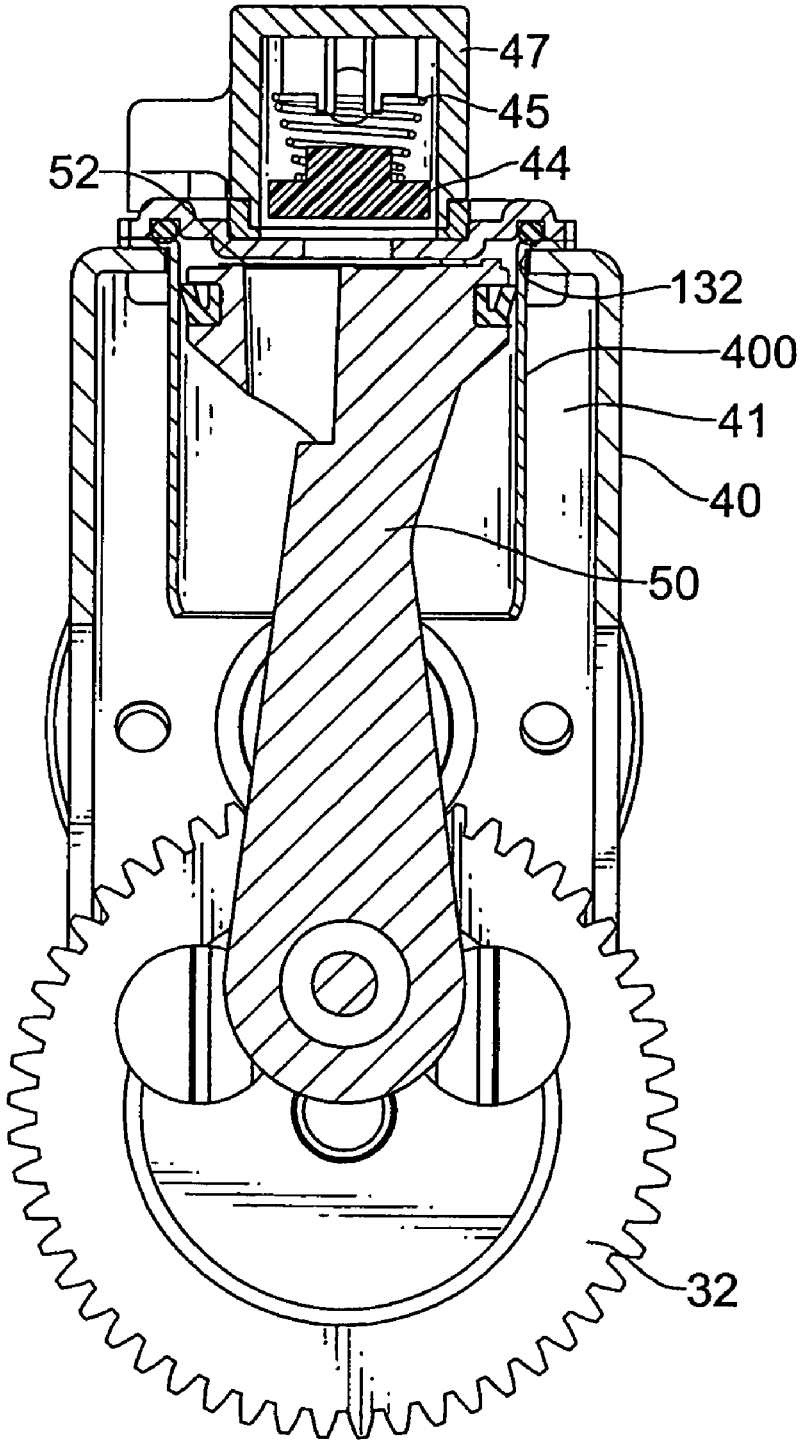
FIG. 5 is a cross sectional front view of the air pump in FIG. 1.

With further reference to FIG. 5, the pneumatic cylinder assembly is mounted on the bracket (10), is connected to the transmission device (30) and has a cylinder housing (40), an outlet valve (47) and a piston (50).

The cylinder housing (40) is mounted on the top plates (13) on the bracket (10), is located in the interval between the top plates (13) and has an open top, an open bottom, a cavity (41), an annular flange (411) and a top cover (42). The cavity is defined in the cylinder housing (40), communicates with the open top and the open bottom and has an inner surface. The annular flange (411) is formed on and protrudes radially out from the open top and is mounted on the top plates (13) on the bracket (10). The top cover (42) is mounted on and covers the open top of the cylinder housing (40) and has a central hole (421) defined through the top cover (42) and communicating with the cavity (41). The cylinder housing (40) further has a cylindrical outer surface (400) engaging with the curved positioning recesses (132) of the top plates (13) of the bracket (10).

The outlet valve (47) is mounted on the top cover (42) on the open top of the cylinder housing (40) and has a chamber, an outlet tube (471), a valve seal (44) and a spring (45). The chamber is defined in the outlet valve (47), communicates with the central hole (421) in the top cover (42) and has an inner surface. The valve seal (44) is mounted movably in the chamber in the outlet valve (47) and selectively seals the central hole (421). The spring (45) is mounted between the inner surface of the chamber and the valve seal (44) and biases the valve seal (44) to seal the central hole (421).

The piston (50) is mounted movably in the cavity (41) in the cylinder housing (40) through the open bottom, is connected pivotally to the eccentric pin (34) on the transmission device (30) and has an inside end, an outside end, a pivot hole (55), a seal head, an air hole (51) and a diaphragm (52). The pivot hole (55) is defined through the outside end and is mounted rotatably around the eccentric pin (34). The seal head is formed on the inside end and hermetically abuts the inner surface of the cavity (41) in the cylinder housing (40). The air hole (51) is defined through the seal head, communicates with the open top and the open bottom of the cylinder housing (40). The diaphragm (52) is made of resilient material, is mounted on the seal head, faces the open top of the cylinder housing (40) and selectively covers and seals the air hole (51).

When the piston (50) moves up, the air pressure in the cavity (41) increases and pushes the valve seal (44) against the spring (45) to open the central hole (421) in the top cover (42). The air is pumped out of the outlet valve (47).

Figure 6:
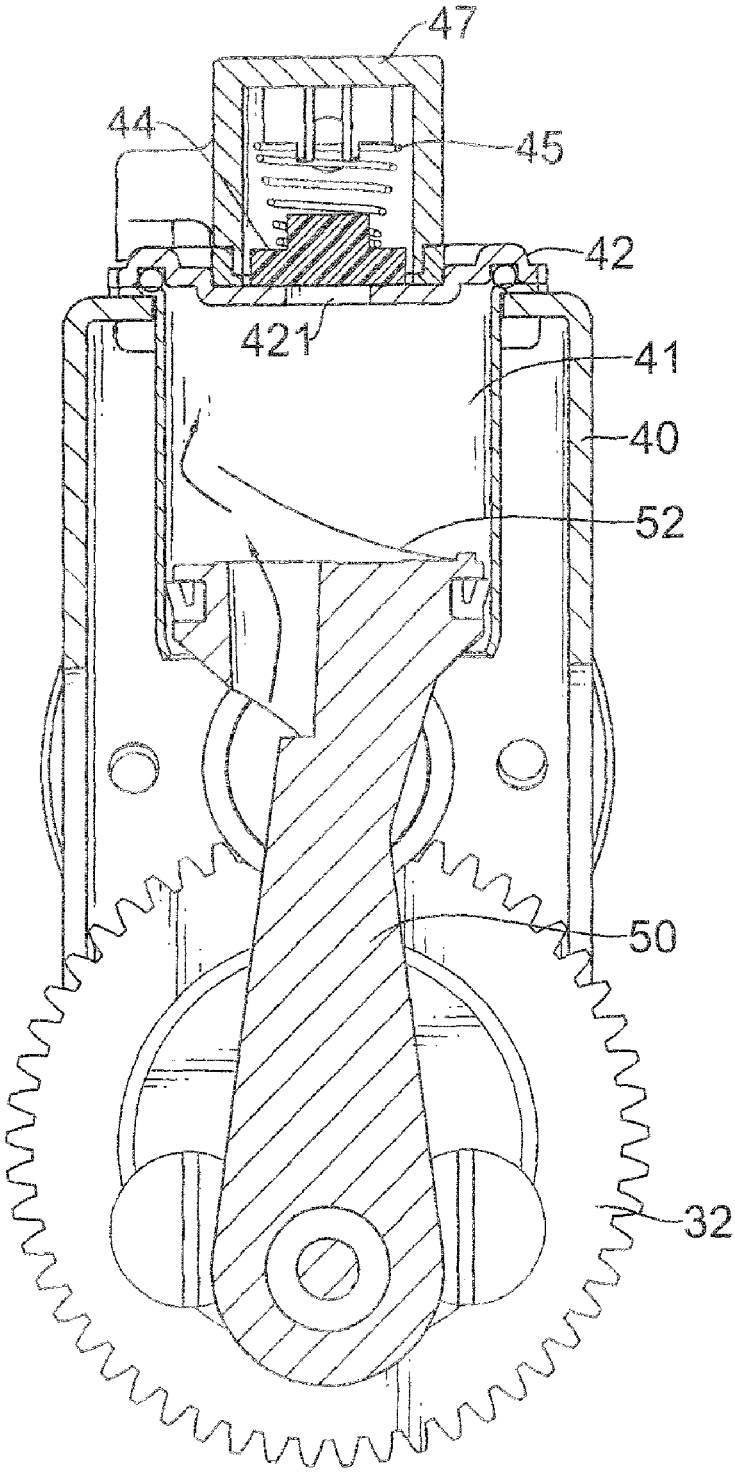
FIG. 6 is an operational cross sectional front view of the air pump in FIG. 5 with the piston moves down.

With further reference to FIG. 6, when the piston moves down, air under the seal head passes through the air hole (51) to open the diaphragm (52).

The backplate (11), the side plates (12) and top plates (13) formed from the sheet metal constructs the firm bracket (10) to securely hold the motor (20), the transmission device (30) and the pneumatic cylinder assembly. Furthermore, the bracket (10) formed from the sheet metal uses less material than that used by a conventional bracket formed by casting so that the bracket (10) is light and saves material. Moreover, the bracket (10) is formed by a punch press so as to be simple to make and has a low precision threshold as compared with the casting means which is complicated and has a high precision threshold. Therefore, the bracket (10) has a high production rate and a low cost.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An air pump comprising:

a bracket formed integrally from a single piece of sheet metal having a uniform and even thickness, and having a backplate formed from the sheet metal and having two opposite sides;

two side plates formed from the sheet metal and being formed respectively on and protruding respectively forward from the sides of the backplate and each side plate having a top edge; and two top plates formed from the sheet metal and being formed respectively on and protruding respectively inward from the top edges of the side plates and facing each other at an interval, wherein each top plate has an inside edge and a curved positioning recess defined in the inside edge, the curved positioning recesses of the top plates being located opposite to each other;

a motor mounted directly on the bracket and having a front end and a shaft mounted rotatably on the front end of the motor;

a transmission device mounted directly on the bracket and connected to the shaft on the motor; and a pneumatic cylinder assembly mounted directly on the bracket, connected to the transmission device and having a cylinder housing mounted on the top plates on the bracket, located in the interval between the top plates and having an open top, an open bottom and a cavity defined in the cylinder housing and communicating with the open top and the open bottom and having an inner surface, wherein the cylinder housing has a cylindrical outer surface engaging with the curved positioning recesses of the top plates of the bracket;

an outlet valve mounted on the open top of the housing and having an outlet tube; and a piston mounted movably in the cavity in the cylinder housing through the open bottom and connected pivotally to the transmission device.

2. The air pump as claimed in claim 1, wherein:

the backplate of the bracket further has a mounting hole defined through the backplate and a pivot hole defined through the backplate; and the front end of the motor is mounted through the mounting hole in the bracket.

3. The air pump as claimed in claim 2, wherein:

the transmission device has a driving gear mounted around the shaft;

a pivot pin mounted in the pivot hole in the bracket;

a driven gear mounted rotatably around the pivot pin, engaging with the driving gear and having a pivot hole defined centrally through the driven gear and mounted rotatably around the pivot pin, and an eccentric hole defined eccentrically through the driven gear; and an eccentric pin mounted in the eccentric hole in the driven gear; and the piston has an inside end;

an outside end;

a pivot hole defined through the outside end and mounted rotatably around the eccentric pin;

a seal head formed on the inside end and hermetically abutting the inner surface of the cavity in the cylinder housing;

an air hole defined through the seal head, communicating with the open top and the open bottom of the cylinder housing; and a diaphragm made of resilient material, mounted on the seal head, facing the open top of the cylinder housing and selectively covering and sealing the air hole.

4. The air pump as claimed in claim 3, wherein the cylinder housing further has an annular flange formed on and protruding radially out from the open top and mounted on the top plates on the bracket; and a top cover mounted on and covering the open top of the cylinder housing and having a central hole defined through the top cover and communicating with the cavity.

5. The air pump as claimed in claim 4, wherein the outlet valve is mounted on the top cover on the cylinder housing and has a chamber defined in the outlet valve, communicating with the central hole in the top cover and having an inner surface;

a valve seal mounted movably in the chamber and selectively sealing the central hole in the top cover; and a spring mounted between the inner surface of the chamber and the valve seal and biasing the valve seal to seal the central hole in the top cover.

* * * * *